US006218959B1

(12) United States Patent
Smith

(10) Patent No.: US 6,218,959 B1
(45) Date of Patent: Apr. 17, 2001

(54) FAIL SAFE DOWNHOLE SIGNAL REPEATER

(75) Inventor: Harrison C. Smith, Anna, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 08/984,382

(22) Filed: Dec. 3, 1997

(51) Int. Cl.[7] ..... G01V 3/00

(52) U.S. Cl. ..... 340/853.7; 340/853.1; 367/82; 166/64

(58) Field of Search ..... 340/853.1, 853.5, 340/853.7, 854.4; 367/82; 166/64

(56) References Cited

U.S. PATENT DOCUMENTS

| | | | |
|---|---|---|---|
| 2,379,800 | 7/1945 | Hare | 175/356 |
| 2,411,696 | 11/1946 | Silverman et al. | 177/352 |
| 3,186,222 | 6/1965 | Martin | 73/151 |
| 3,205,477 | 9/1965 | Kalbfell | 340/18 |
| 3,333,239 | 7/1967 | Silverman | 340/18 |
| 3,793,632 | 2/1974 | Still | 340/18 |
| 3,930,220 | 12/1975 | Shawhan | 340/18 FM |
| 4,019,148 | 4/1977 | Shawhan | 328/167 |
| 4,087,781 | 5/1978 | Grossi et al. | 340/18 NC |
| 4,181,014 | 1/1980 | Zuvela et al. | 73/151 |
| 4,215,426 | 7/1980 | Klatt et al. | 367/83 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,757 | 11/1981 | Still | 340/854 |
| 4,348,672 | 9/1982 | Givier | 340/854 |
| 4,363,137 | 12/1982 | Salisbury | 455/40 |
| 4,387,372 | 6/1983 | Smith et al. | 340/854 |
| 4,406,919 | 9/1983 | Pospischil | 178/69 G |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,562,559 | 12/1985 | Sharp et al. | 367/82 |
| 4,578,675 | 3/1986 | MacLeod | 340/855 |
| 4,616,702 | 10/1986 | Hanson et al. | 166/65.1 |
| 4,684,946 | 8/1987 | Issenmann | 340/855 |
| 4,691,203 | 9/1987 | Rubin et al. | 340/856 |
| 4,725,837 | 2/1988 | Rubin | 340/855 |
| 4,739,325 | 4/1988 | MacLeod | 340/854 |
| 4,757,157 | 7/1988 | Pelet | 174/50 |
| 4,766,442 | 8/1988 | Issenmann | 343/719 |
| 4,788,544 | 11/1988 | Howard | 340/853 |
| 4,800,570 | 1/1989 | Perrotta et al. | 375/4 |
| 4,839,644 | 6/1989 | Safinya et al. | 340/854 |
| 4,845,493 | 7/1989 | Howard | 340/853 |
| 4,901,069 | 2/1990 | Veneruso | 340/853 |
| 4,908,804 | 3/1990 | Rorden | 367/81 |
| 4,933,640 | 6/1990 | Kuckes | 324/339 |

(List continued on next page.)

FOREIGN PATENT DOCUMENTS

| | | | |
|---|---|---|---|
| 0 597 730 A1 | 5/1994 | (EP) | E21B/34/06 |
| 0 672 819 A2 | 9/1995 | (NO) . | |

*Primary Examiner*—Michael Horabik
*Assistant Examiner*—Timothy Edwards, Jr.
(74) *Attorney, Agent, or Firm*—Michael D. McCully; Lawrence R. Youst

(57) ABSTRACT

A system and method of fail safe communication of information between surface equipment and downhole equipment are disclosed. The system comprises two or more repeaters (34, 35, 36) disposed within a wellbore (38) such that two repeaters (34, 35) will receive each signal carrying information that is telemetered. The repeater (35) that is farther from the source (44) will include a memory device (292) that stores the information carried in the signal. A timer device (293) also in the repeater (35) that is farther from the source (44) will trigger the retransmission of the information after a predetermined time period unless the repeater (35) that is farther from the source (44) has detected a signal carrying the information generated by the repeater (34) that is closer to the source (44).

42 Claims, 7 Drawing Sheets

U.S. PATENT DOCUMENTS

| | | | | |
|---|---|---|---|---|
| 4,968,978 | | 11/1990 | Stolarczyk | 340/854 |
| 5,087,099 | | 2/1992 | Stolarczyk | 299/1 |
| 5,130,706 | | 7/1992 | Van Steenwyk | 340/584.6 |
| 5,160,925 | | 11/1992 | Dailey et al. | 340/853.3 |
| 5,268,683 | | 12/1993 | Stolarczyk | 340/854.4 |
| 5,293,937 | * | 3/1994 | Schultz et al. | 166/250 |
| 5,343,963 | * | 9/1994 | Bouldin et al. | 175/27 |
| 5,394,141 | | 2/1995 | Soulier | 340/854.4 |
| 5,396,232 | | 3/1995 | Mathieu et al. | 340/854.5 |
| 5,448,227 | | 9/1995 | Orban et al. | 340/854.4 |
| 5,467,083 | | 11/1995 | McDonald et al. | 340/854.6 |
| 5,467,832 | | 11/1995 | Orban et al. | 175/45 |
| 5,493,288 | | 2/1996 | Henneuse | 340/854.4 |
| 5,530,358 | | 6/1996 | Wisler et al. | 324/338 |
| 5,576,703 | | 11/1996 | MacLeod et al. | 340/854.4 |
| 5,583,504 | | 12/1996 | Huggett | 342/15 |
| 5,942,990 | * | 8/1999 | Smith et al. | 340/853.7 |

* cited by examiner

FAIL SAFE DOWNHOLE SIGNAL REPEATER

TECHNICAL FIELD OF THE INVENTION

This invention relates in general to downhole telemetry and, in particular to, the use of fail safe downhole signal repeaters for communicating signals carrying information between surface equipment and downhole equipment.

BACKGROUND OF THE INVENTION

Without limiting the scope of the invention, its background is described in connection with transmitting downhole data to the surface during measurements while drilling (MWD), as an example. It should be noted that the principles of the present invention are applicable not only during drilling, but throughout the life of a wellbore including, but not limited to, during logging, testing, completing and production.

Heretofore, in this field, a variety of communication and transmission techniques have been attempted to provide real time data from the vicinity of the bit to the surface during drilling. The utilization of MWD with real time data transmission provides substantial benefits during a drilling operation. For example, continuous monitoring of downhole conditions allows for an immediate response to potential well control problems and improves mud programs.

Measurement of parameters such as bit weight, torque, wear and bearing condition in real time provides for a more efficient drilling operations. In fact, faster penetration rates, better trip planning, reduced equipment failures, fewer delays for directional surveys, and the elimination of a need to interrupt drilling for abnormal pressure detection is achievable using MWD techniques.

At present, there are four major categories of telemetry systems that have been used in an attempt to provide real time data from the vicinity of the drill bit to the surface, namely mud pressure pulses, insulated conductors, acoustics and electromagnetic waves.

In a mud pressure pulse system, the resistance of mud flow through a drill string is modulated by means of a valve and control mechanism mounted in a special drill collar near the bit. This type of system typically transmits at 1 bit per second as the pressure pulse travels up the mud column at or near the velocity of sound in the mud. It has been found, however, that the rate of transmission of measurements is relatively slow due to pulse spreading, modulation rate limitations, and other disruptive limitations such as the requirement of mud flow.

Insulated conductors, or hard wire connection from the bit to the surface, is an alternative method for establishing downhole communications. This type of system is capable of a high data rate and two way communication is possible. It has been found, however, that this type of system requires a special drill pipe and special tool joint connectors which substantially increase the cost of a drilling operation. Also, these systems are prone to failure as a result of the abrasive conditions of the mud system and the wear caused by the rotation of the drill string.

Acoustic systems have provided a third alternative. Typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission.

The fourth technique used to telemeter downhole data to the surface uses the transmission of electromagnetic waves through the earth. A current carrying downhole data is input to a toroid or collar positioned adjacent to the drill bit or input directly to the drill string. When a toroid is utilized, a primary winding, carrying the data for transmission, is wrapped around the toroid and a secondary is formed by the drill pipe. A receiver is connected to the ground at the surface where the electromagnetic data is picked up and recorded. It has been found, however, that in deep or noisy well applications, conventional electromagnetic systems are unable to generate a signal with sufficient intensity to reach the surface.

Therefore, a need has arisen for a system that is capable of telemetering real time information in a deep or noisy well between surface equipment and downhole equipment. A need has also arisen for a signal repeater that digitally processes the information to determine whether the signal is intended for that repeater. Further, a need has arisen for a fail safe repeater system that is capable of transmitting information between surface equipment and downhole equipment even in the event of a repeater failure.

SUMMARY OF THE INVENTION

The present invention disclosed herein uses fail safe signal repeaters that amplify and process signals carrying information in a system capable of transmitting information between surface equipment and downhole equipment even in the event of a repeater failure. The system and method of the present invention provide for real time communication from downhole equipment to the surface and for the telemetry of information and commands from the surface to downhole tools disposed in a well.

The system and method of the present invention utilize at least two repeaters which, for convenience of illustration, will be referred to as first and second repeaters. The first and second repeaters are disposed within a wellbore and receive a first signal carrying information. A memory device within the second repeater stores the information carried in the first signal until a timer device within the second repeater triggers the second repeater to retransmit the information. The timer device will trigger the retransmission of the information, after a predetermined time period, unless the second repeater has detected a third signal carrying the information transmitted by the first repeater. Thus, even if the first repeater is inoperable, the information carried in the first signal is retransmitted by the second repeater. If the first repeater transmits the third signal carrying the information within the predetermined time period and the third signal carrying the information is detected by the second repeater, the second repeater will discard the information stored in the memory device and process the information carried in the third signal.

The first and second repeaters of the present invention include electronics packages. The electronics packages transform the first signal into an electrical signal, convert the information carried in the electrical signal from an analog format to a digital format, process the information and convert the information carried in the electrical signal from a digital format to an analog format. The electronics packages also determine whether the first signal is intended for the first or the second repeater. Additionally, the electronics packages determine whether the first signal is carrying the information and whether the information carried in the first signal is accurate. The electronics packages also attenuate noise in the electrical signal to a predetermined voltage, amplify the electrical signal to a predetermined voltage, eliminate noise in the electrical signal in a predetermined frequency range and eliminate the unwanted frequencies above and below the desired frequency.

In one embodiment of the present invention, the first and second repeaters may each include an electromagnetic receiver and an electromagnetic transmitter or may include an electromagnetic transceiver.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
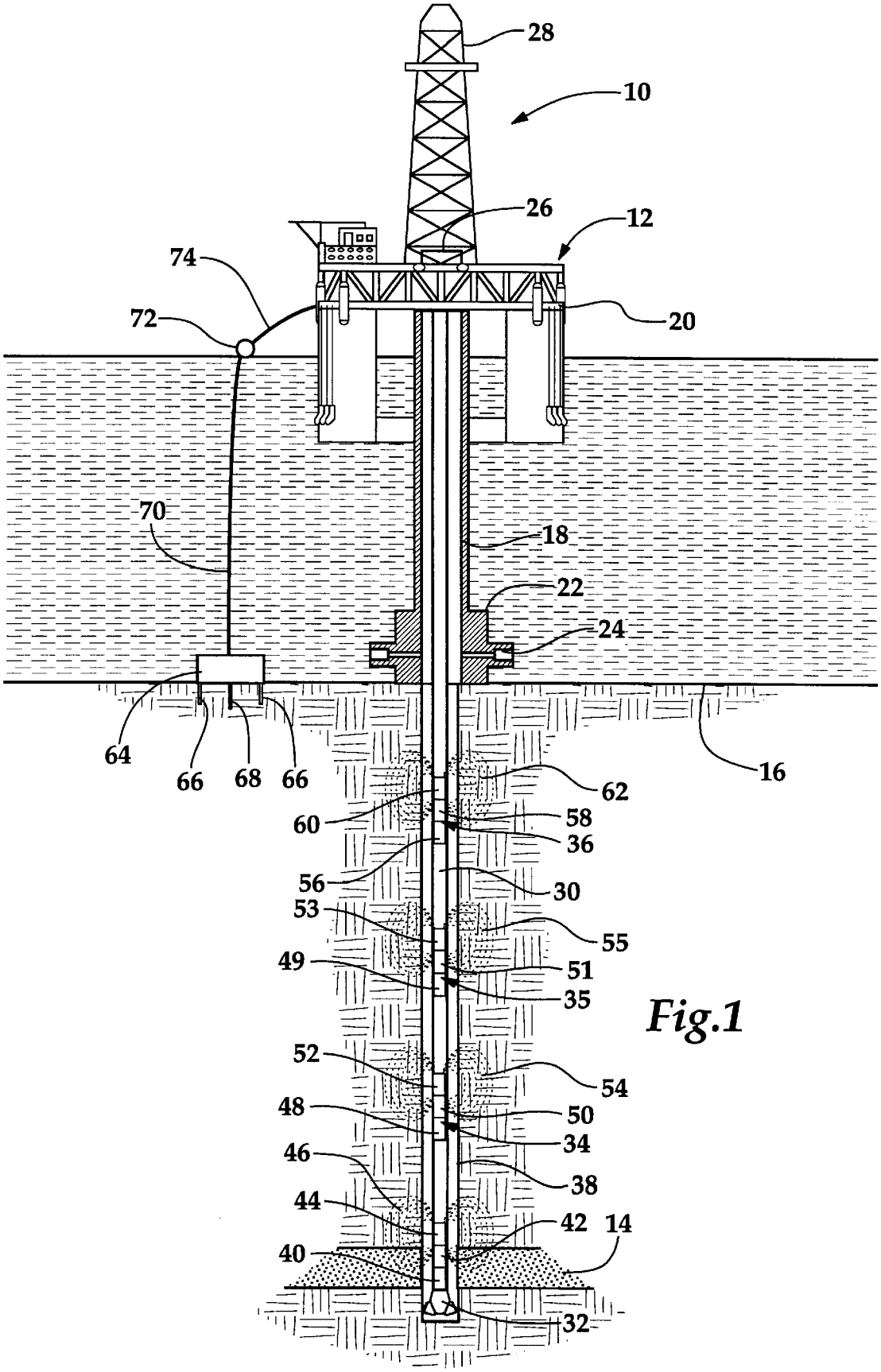
FIG. 1 is a schematic illustration of an offshore oil or gas drilling platform operating three fail safe downhole signal repeaters of the present invention.

Referring to FIG. 1, a plurality of fail safe downhole signal repeaters in use on an offshore oil and gas drilling platform is schematically illustrated and generally designated 10. A semi-submergible platform 12 is centered over a submerged oil and gas formation 14 located below sea floor 16. A subsea conduit 18 extends from deck of 20 platform 12 to wellhead installation 22 including blowout preventers 24. Platform 12 has a derrick 26 and a hoisting apparatus 28 for raising and lowering drill string 30, including drill bit 32 and fail safe downhole signal repeaters 34, 35, 36.

In a typical drilling operation, drill bit 32 is rotated by drill string 30, such that drill bit 32 penetrates through the various earth strata, forming wellbore 38. Measurement of parameters such as bit weight, torque, wear and bearing conditions may be obtained by sensors 40 located in the vicinity of drill bit 32. Additionally, parameters such as pressure and temperature as well as a variety of other environmental and formation information may be obtained by sensors 40. The signal generated by sensors 40 may typically be analog, which must be converted to digital data before electromagnetic transmission in the present system. The signal generated by sensors 40 is passed into an electronics package 42 including an analog to digital converter which converts the analog signal to a digital code utilizing "ones" and "zeros" for information transmission.

Electronics package 42 may also include electronic devices such as an on/off control, a modulator, a microprocessor, memory and amplifiers. Electronics package 42 is powered by a battery pack which may include a plurality of batteries, such as nickel cadmium or lithium batteries, which are configured to provide proper operating voltage and current.

Once the electronics package 42 establishes the frequency, power and phase output of the information, electronics package 42 feeds the information to transmitter 44. Transmitter 44 may be a direct connect to drill string 30 or may electrically approximate a large transformer. The information is then carried uphole in the form of electromagnetic wave fronts 46 which propagate through the earth. These electromagnetic wave fronts 46 are picked up by receiver 48 of repeater 34 and receiver 49 of repeater 35 located uphole from transmitter 44.

Repeater 34 and repeater 35 are spaced along drill string 30 to receive electromagnetic wave fronts 46 while electromagnetic wave fronts 46 remain strong enough to be readily detected. Receiver 48 of repeater 34 and receiver 49 of repeater 49 may each electrically approximate a large transformer. As electromagnetic wave fronts 46 reach receivers 48, 49, a current is induced in receivers 48, 49 that carries the information originally obtained by sensors 40.

The current from receiver 48 is fed to an electronics package 50 that may include a variety of electronic devices such as amplifiers, limiters, filters, a phase lock loop, shift registers and comparators as will be further discussed with reference to FIGS. 9 and 11. Electronics package 50 digitally processes the signal and amplifies the signal to reconstruct the original waveform, compensating for losses and distortion occurring during the transmission of electromagnetic wave fronts 46 through the earth. Electronics package 50 also determines whether the signal was intended for repeater 34 by analyzing the address information carried in the preamble of the signal, as will be explained in more detail with reference to FIG. 11 below. In this case, electromagnetic wave fronts 46 are intended for repeater 34 thus, electronics package 50 forwards the signal to a transmitter 52 that radiates electromagnetic wave fronts 54 into the earth in the manner described with reference to transmitter 44 and electromagnetic wave fronts 46.

Similarly, the current from receiver 49 of repeater 35 is fed to an electronics package 51 that may also include a variety of electronic devices such as amplifiers, limiters, filters, a phase lock loop, a timing device, shift registers and comparators as will be further discussed with reference to FIGS. 9 and 11. Electronics package 51 digitally processes the signal and amplifies the signal to reconstruct the original waveform, compensating for losses and distortion occurring during the transmission of electromagnetic wave fronts 46 through the earth. Electronics package 51 determines whether the signal was intended for repeater 35 by analyzing the address information carried in the preamble of the signal, as will be explained in more detail with reference to FIG. 11 below. In this case, electromagnetic wave fronts 46 are not intended for repeater 35 but are intended for repeater 34. Because electromagnetic wave fronts 46 are not intended for repeater 35, electronics package 51 simply processes and stores the information carried in electromagnetic wave fronts 46 but does not immediately forward the signal to transmitter 53. The signal is forwarded only if repeater 35 does not receive electromagnetic wave fronts 54 from repeater 34 within a specified period of time. If repeater 35 receives electromagnetic wave fronts 54 within the specified period of time, repeater 35 discards the information received in electromagnetic waves fronts 46 and processes the information carried in electromagnetic wave fronts 54 as described above. Alternatively, if repeater 35 does not receive electromagnetic wave fronts 54 within the specified period of time, repeater 35 will forward the signal originally obtained from electromagnetic waves fronts 46 to transmitter 53 that radiates electromagnetic wave fronts 55 into the earth in the manner described with reference to transmitter 44 and electromagnetic wave fronts 46.

As the information continues to be transmitted uphole, fail safe processing is accomplished by each repeater as well as by electromagnetic pickup device 64. For example, electromagnetic wave fronts 54 are received by receiver 49 of repeater 35 and receiver 56 of repeater 36. The signal is processed by electronics packages 51 of repeater 35 and by electronics package 58 of repeater 36 as explained above. While electromagnetic wave fronts 54 are intended for repeater 35, if repeater 35 is unable to retransmit the information via the generation of electromagnetic wave fronts 55 from transmitter 53 within a specified time period, repeater 36 will generate electromagnetic wave fronts 62 from transmitter 60 to continue the process of fail safe transmission of the information originally obtained by sensors 40.

Likewise, electromagnetic wave fronts 55 are received by receiver 56 of repeater 36 as well as by electromagnetic pickup device 64 located on sea floor 16. Electromagnetic pickup device 64 may sense either the electric field or the magnetic field of electromagnetic wave front 55 using electric field sensors 66 or a magnetic field sensor 68 or both. The signal is processed by electronics packages 58 of repeater 36 and by electromagnetic pickup device 64 in the manner explained above. While electromagnetic wave fronts 55 are intended for repeater 36, if repeater 36 is unable to retransmit the information via the generation of electromagnetic wave fronts 62 from transmitter 60 within a specified time period, electromagnetic pickup device 64 will fire the information received in electromagnetic wave fronts 55 to the surface via wire 70 that is connected to buoy 72 and wire 74 that is connected to a processor on platform 12. Upon reaching platform 12, the information originally obtained by sensors 40 is further processed making any necessary calculations and error corrections such that the information may be displayed in a usable format.

Alternatively, when repeater 36 does generate electromagnetic wave fronts 62 from transmitter 60 within a specified time period, electromagnetic pickup device 64 discards the information received from electromagnetic wave fronts 55 and processes the information received from electromagnetic wave fronts 62. Electromagnetic pickup device 64 then fires the information received in electromagnetic wave fronts 62 to the surface via wire 70 that is connected to buoy 72 and wire 74 that is connected to a processor on platform 12. Upon reaching platform 12, the information originally obtained by sensors 40 is further processed making any necessary calculations and error corrections such that the information may be displayed in a usable format.

In this manner, the fail safe downhole repeaters of the present invention are able to transmit information at a great distance between the surface and a downhole location even if a failure occurs in the transmission of information by any repeater, such as repeaters 34, 35, 36. The system of the present invention will therefore avoid the high cost of tripping drill string 30 out of wellbore 38 to repair the communication system in the event of a repeater failure. Similarly, the use of the fail safe downhole repeater system of the present invention during production of fluids from formation 14 will eliminate the need to bring out a rig to repair the communication system due to a repeater failure.

Even though FIG. 1 depicts three repeaters 34, 35, 36, it should be noted by one skilled in the art that the number of repeaters located within drill string 30 will be determined by the depth of wellbore 38, the noise level in wellbore 38 and the characteristics of the earth's strata adjacent to wellbore 38 in that electromagnetic waves suffer from attenuation with increasing distance from their source at a rate that is dependent upon the composition characteristics of the transmission medium and the frequency of transmission. For example, repeaters 34, 35, 36 may be positioned between 2,000 and 4,000 feet apart. Thus, if wellbore 38 is 15,000 feet deep, between three and seven repeaters would be desirable.

Even though FIG. 1 depicts repeaters 34, 35, 36 and electromagnetic pickup device 64 in an offshore environment, it should be understood by one skilled in the art that repeaters 34, 35, 36 and electromagnetic pickup device 64 are equally well-suited for operation in an onshore environment. In fact, in an onshore environment, electromagnetic pickup device 64 would be placed directly on the land. Alternatively, a receiver such as receivers 48, 49, 56 could be used at the surface to pick up the electromagnetic wave fronts for processing at the surface.

Additionally, while FIG. 1 has been described with reference to transmitting information uphole during a measurement while drilling operation, it should be understood by one skilled in the art that repeaters 34, 35, 36 and electromagnetic pickup device 64 may be used in conjunction with the transmission of information downhole from surface equipment to downhole tools to perform a variety of functions such as opening and closing a downhole tester valve or controlling a downhole choke.

Further, even though FIG. 1 has been described with reference to one way communication from the vicinity of drill bit 32 to platform 12, it should be understood by one skilled in the art that the principles of the present invention are applicable to two way communication. For example, a surface installation may be used to request downhole pressure, temperature, or flow rate information from formation 14 by sending electromagnetic wave fronts downhole using electromagnetic pickup device 64 as an electromagnetic transmitter and retransmitting the request using repeaters 34, 35, 36 as described above. Sensors, such as sensors 40, located near formation 14 receive this request and obtain the appropriate information which would then be returned to the surface via electromagnetic wave fronts which would again be retransmitted as described above with reference to repeaters 34, 35, 36. As such, the phrase "between surface equipment and downhole equipment" as used herein encompasses the transmission of information from surface equipment downhole, from downhole equipment uphole or for two way communication.

Even though FIG. 1 has been described with reference to communication using electromagnetic waves, it should been understood by those of skill in the art that the principles of the present invention are equally well-suited for use with other communication systems including, but not limited to, acoustic repeaters, electromagnetic-to-acoustic repeaters, acoustic-to-electromagnetic repeaters as well as repeaters that retransmit both electromagnetic and acoustic signals.

Figure 2A:
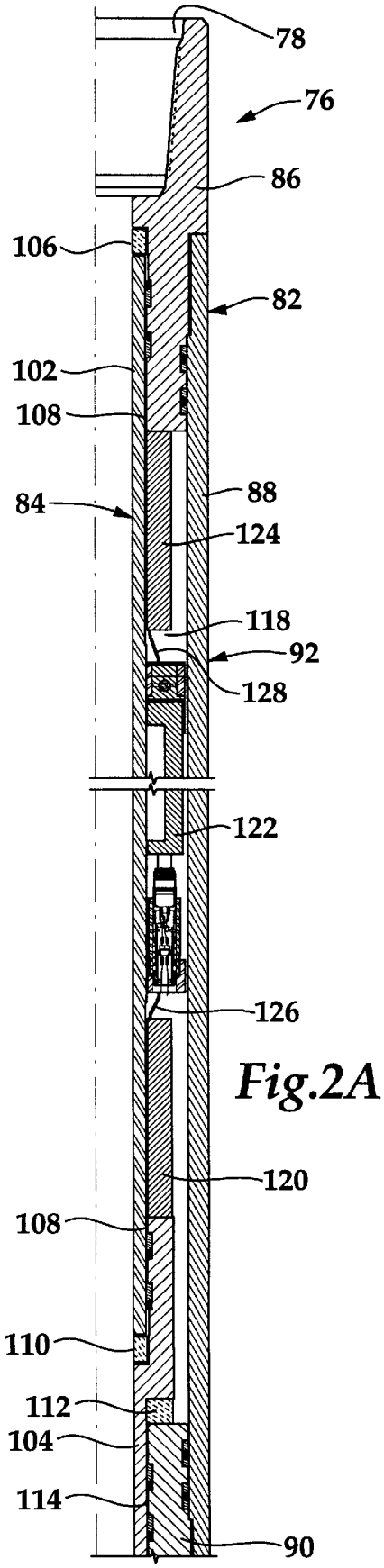
FIGS. 2A–2B are quarter-sectional views of a fail safe downhole signal repeater of the present invention.
Figure 2B:
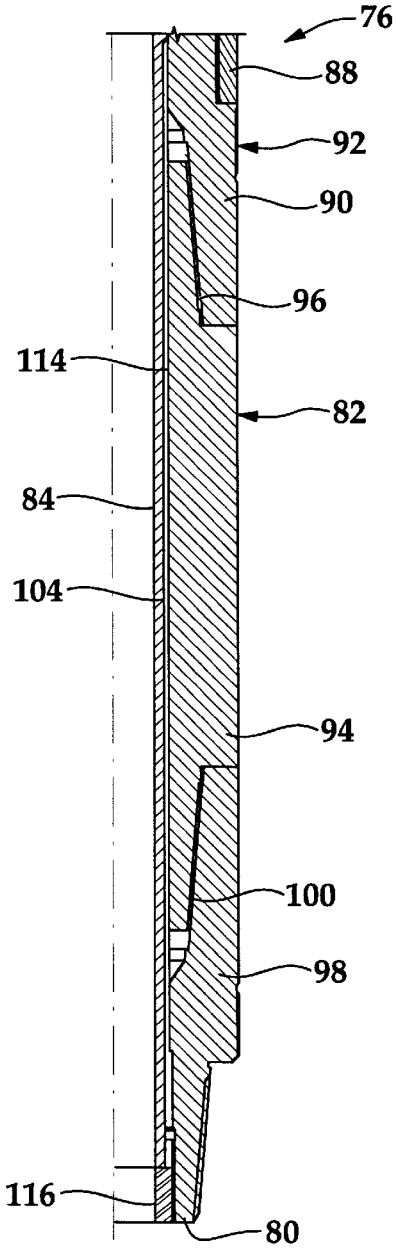

Representatively illustrated in FIGS. 2A–2B is one embodiment of a fail safe downhole signal repeater 76 of the present invention. For convenience of illustration, FIGS. 2A–2B depict repeater 76 in a quarter sectional view.

Repeater 76 has a box end 78 and a pin end 80 such that repeater 76 is threadably adaptable to drill string 30. Repeater 76 has an outer housing 82 and a mandrel 84 having a full bore so that when repeater 76 is interconnected with drill string 30, fluids may be circulated therethrough and therearound. Specifically, during a drilling operation, drilling mud is circulated through drill string 30 inside mandrel 84 of repeater 76 to ports formed through drill bit 32 and up the annulus formed between drill string 30 and wellbore 38 exteriorly of housing 82 of repeater 76. Housing 82 and mandrel 84 thereby protect the operable components of repeater 76 from drilling mud or other fluids disposed within wellbore 38 and within drill string 30.

Housing 82 of repeater 76 includes an axially extending generally tubular upper connecter 86 which has box end 78 formed therein. Upper connecter 86 may be threadably and sealably connected to drill string 30 for conveyance into wellbore 38.

An axially extending generally tubular intermediate housing member 88 is threadably and sealably connected to upper connecter 86. An axially extending generally tubular lower housing member 90 is threadably and sealably connected to intermediate housing member 88. Collectively, upper connecter 86, intermediate housing member 88 and lower housing member 90 form upper subassembly 92. Upper subassembly 92 is electrically connected to the section of drill string 30 above repeater 76.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as teflon, chosen for its dielectric properties and capably of withstanding compression loads without extruding.

An axially extending generally tubular lower connecter 98 is securably and sealably coupled to isolation subassembly 94. Disposed between lower connecter 98 and isolation subassembly 94 is a dielectric layer 100 that electrically isolates lower connecter 98 from isolation subassembly 94. Lower connecter 98 is adapted to threadably and sealably connect to drill string 30 and is electrically connected to the portion of drill string 30 below repeater 76.

Isolation subassembly 94 provides a discontinuity in the electrical connection between lower connecter 98 and upper subassembly 92 of repeater 76, thereby providing a discontinuity in the electrical connection between the portion of drill string 30 below repeater 76 and the portion of drill string 30 above repeater 76.

It should be apparent to those skilled in the art that the use of directional terms such as above, below, upper, lower, upward, downward, etc. are used in relation to the illustrative embodiments as they are depicted in the figures, the upward direction being toward the top of the corresponding figure and the downward direction being toward the bottom of the corresponding figure. It is to be understood that repeater 76 may be operated in vertical, horizontal, inverted or inclined orientations without deviating from the principles of the present invention.

Mandrel 84 includes axially extending generally tubular upper mandrel section 102 and axially extending generally tubular lower mandrel section 104. Upper mandrel section 102 is partially disposed and sealing configured within upper connecter 86. A dielectric member 106 electrically isolates upper mandrel section 102 from upper connecter 86. The outer surface of upper mandrel section 102 has a dielectric layer disposed thereon. Dielectric layer 108 may be, for example, a teflon layer. Together, dielectric layer 108 and dielectric member 106 serve to electrically isolate upper connecter 86 from upper mandrel section 102.

Between upper mandrel section 102 and lower mandrel section 104 is a dielectric member 110 that, along with dielectric layer 108, serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112, provides for electric isolation of lower mandrel section 104 from lower housing number 90. Dielectric layer 114 also provides for electric isolation between lower mandrel section 104 and isolation subassembly 94 as well as between lower mandrel section 104 and lower connecter 98. Lower end 116 of lower mandrel section 104 is disposed within lower connecter 98 and is in electrical communication with lower connecter 98.

Intermediate housing member 88 of outer housing 82 and upper mandrel section 102 of mandrel 84 define annular area 118. A receiver 120, an electronics package 122 and a transmitter 124 are disposed within annular area 118. In operation, receiver 1receives an electromagnetic input signal carrying information which is transformed into an electrical signal that is passed onto electronics package 122 via electrical conductor 126, as will be more fully described with reference to FIG. 4. Electronics package 122 processes and amplifies the electrical signal, as will be more fully discussed with reference to FIG. 11. The electrical signal is then fed to transmitter 124 via electrical conductor 128, as will be more fully described with reference to FIG. 4. Transmitter 124 transforms the electrical signal into an electromagnetic output signal carrying information that is radiated into the earth.

Figure 3A:
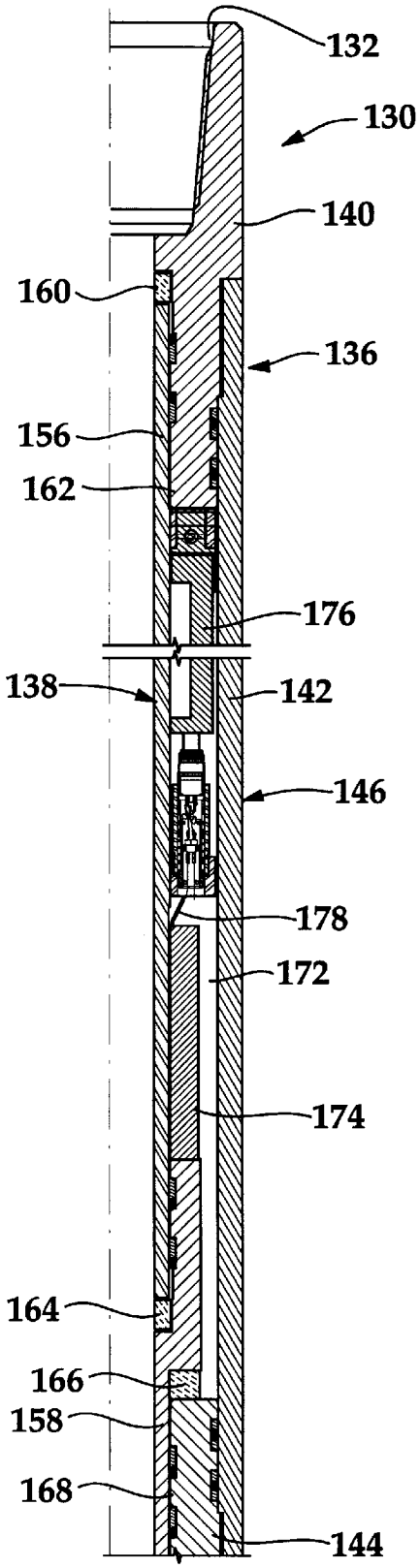
FIGS. 3A–3B are quarter-sectional views of a fail safe downhole signal repeater of the present invention.
Figure 3B:
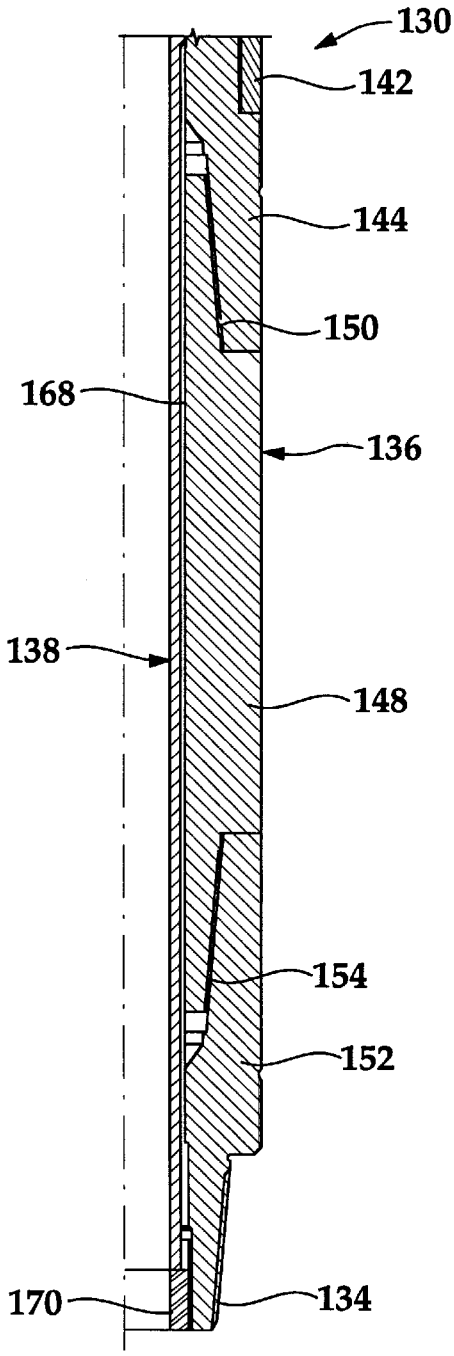

Representatively illustrated in FIGS. 3A–3B is another embodiment of a fail safe downhole signal repeater 130 of the present invention. For convenience of illustration, FIGS. 3A–3B depicted repeater 130 in a quarter sectional view. Repeater 130 has a box end 132 and a pin end 134 such that repeater 130 is threadably adaptable to drill string 30. Repeater 130 has an outer housing 136 and a mandrel 138 such that repeater 130 may be interconnected with drill string 30 providing a circulation path for fluids therethrough and therearound. Housing 136 and mandrel 138 thereby protect the operable components of repeater 130 from drilling mud or other fluids disposed within wellbore 38 and within drill string 30.

Housing 136 of repeater 130 includes an axially extending generally tubular upper connecter 140 which has box end 132 formed therein. Upper connecter 140 may be threadably and sealably connected to drill string 30 for conveyance into wellbore 38.

An axially extending generally tubular intermediate housing member 142 is threadably and sealably connected to upper connecter 140. An axially extending generally tubular lower housing member 144 is threadably and sealably connected to intermediate housing member 142. Collectively, upper connecter 140, intermediate housing member 142 and lower housing member 144 form upper subassembly 146. Upper subassembly 146 is electrically connected to the section of drill string 30 above repeater 130.

An axially extending generally tubular isolation subassembly 148 is securably and sealably coupled to lower housing member 144. Disposed between isolation subassembly 148 and lower housing member 144 is a dielectric layer 150 that provides electric isolation between lower housing member 144 and isolation subassembly 148. Dielectric layer 150 is composed of a dielectric material chosen for its dielectric properties and capably of withstanding compression loads without extruding.

An axially extending generally tubular lower connecter 152 is securably and sealably coupled to isolation subassembly 148. Disposed between lower connecter 152 and isolation subassembly 148 is a dielectric layer 154 that electrically isolates lower connecter 152 from isolation subassembly 148. Lower connecter 152 is adapted to threadably and sealably connect to drill string 30 and is electrically connected to the portion of drill string 30 below repeater 130.

Isolation subassembly 148 provides a discontinuity in the electrical connection between lower connecter 152 and upper subassembly 146 of repeater 130, thereby providing a discontinuity in the electrical connection between the portion of drill string 30 below repeater 130 and the portion of drill string 30 above repeater 130.

Mandrel 138 includes axially extending generally tubular upper mandrel section 156 and axially extending generally tubular lower mandrel section 158. Upper mandrel section 156 is partially disposed and sealing configured within upper connecter 140. A dielectric member 160 electrically isolates upper mandrel section 156 and upper connecter 140. The outer surface of upper mandrel section 156 has a dielectric layer disposed thereon. Dielectric layer 162 may be, for example, a teflon layer. Together, dielectric layer 162 and dielectric member 160 service to electrically isolate upper connecter 140 from upper mandrel section 156.

Between upper mandrel section 156 and lower mandrel section 158 is a dielectric member 164 that, along with dielectric layer 162, serves to electrically isolate upper mandrel section 156 from lower mandrel section 158. Between lower mandrel section 158 and lower housing member 144 is a dielectric member 166. On the outer surface of lower mandrel section 158 is a dielectric layer 168 which, along with dielectric member 166, provides for electric isolation of lower mandrel section 158 with lower housing number 144. Dielectric layer 168 also provides for electric isolation between lower mandrel section 158 and isolation subassembly 148 as well as between lower mandrel section 158 and lower connecter 152. Lower end 170 of lower mandrel section 158 is disposed within lower connecter 152 and is in electrical communication with lower connecter 152.

Intermediate housing member 142 of outer housing 136 and upper mandrel section 156 of mandrel 138 define annular area 172. A transceiver 174 and an electronics package 176 are disposed within annular area 172. In operation, transceiver 174 receives an electromagnetic input signal carrying information which is transformed into an electrical signal that is passed onto electronics package 176 via electrical conductor 178. Electronics package 176 processes and amplifies the electrical signal which is fed back to transceiver 174 via electrical conductor 178. Transceiver 174 transforms the electrical signal into an electromagnetic output signal that is radiated into the earth carrying information.

Figure 4A:
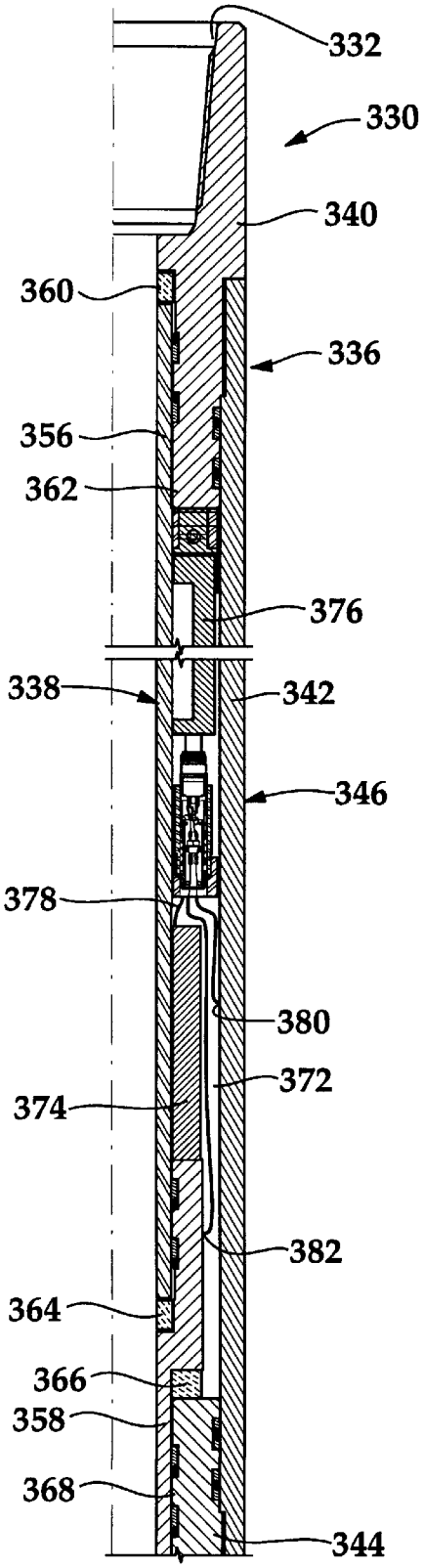
FIG. 4A–4B are quarter-sectional views of a fail safe downhole signal repeater of the present invention.
Figure 4B:
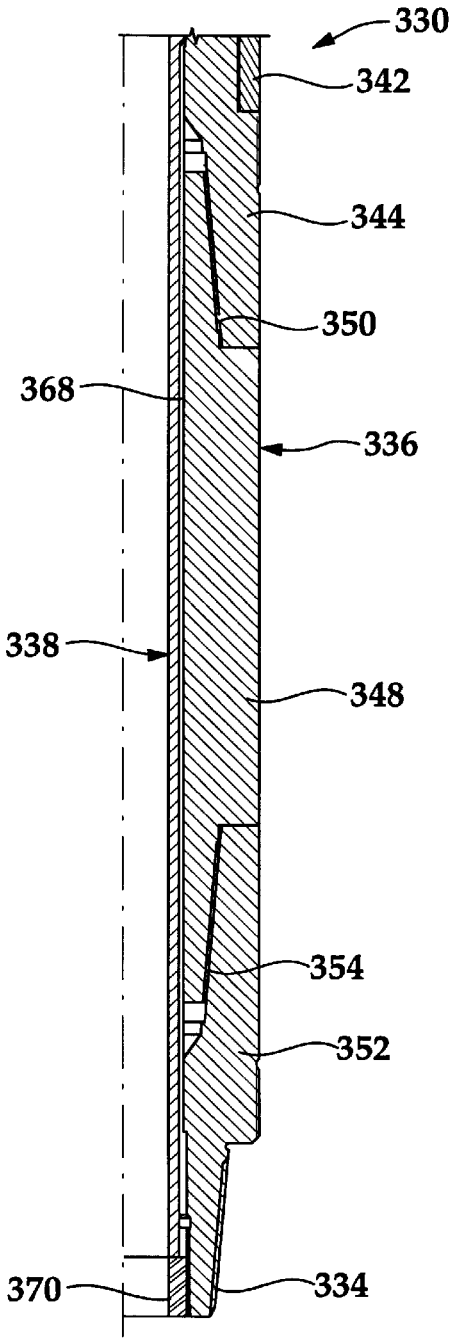

Representatively illustrated in FIGS. 4A–4B is another embodiment of a fail safe downhole signal repeater 330 of the present invention. For convenience of illustration, FIGS. 4A–4B depicted repeater 330 in a quarter sectional view. Repeater 330 has a box end 332 and a pin end 334 such that repeater 330 is threadably adaptable to drill string 30. Repeater 330 has an outer housing 336 and a mandrel 338 such that repeater 330 may be interconnected with drill string 30 providing a circulation path for fluids therethrough and therearound. Housing 336 and mandrel 338 thereby protect the operable components of repeater 330 from drilling mud or other fluids disposed within wellbore 38 and within drill string 30.

Housing 336 of repeater 330 includes an axially extending generally tubular upper connecter 340 which has box end 332 formed therein. Upper connecter 340 may be threadably and sealably connected to drill string 30 for conveyance into wellbore 38.

An axially extending generally tubular intermediate housing member 342 is threadably and sealably connected to upper connecter 340. An axially extending generally tubular lower housing member 344 is threadably and sealably connected to intermediate housing member 342. Collectively, upper connecter 340, intermediate housing member 342 and lower housing member 344 form upper subassembly 346. Upper subassembly 346 is electrically connected to the section of drill string 30 above repeater 330.

An axially extending generally tubular isolation subassembly 348 is securably and sealably coupled to lower housing member 344. Disposed between isolation subassembly 348 and lower housing member 344 is a dielectric layer 350 that provides electric isolation between lower housing member 344 and isolation subassembly 348. Dielectric layer 350 is composed of a dielectric material chosen for its dielectric properties and capably of withstanding compression loads without extruding.

An axially extending generally tubular lower connecter 352 is securably and sealably coupled to isolation subassembly 348. Disposed between lower connecter 352 and isolation subassembly 348 is a dielectric layer 354 that electrically isolates lower connecter 352 from isolation subassembly 348. Lower connecter 352 is adapted to threadably and sealably connect to drill string 30 and is electrically connected to the portion of drill string 30 below repeater 330.

Isolation subassembly 348 provides a discontinuity in the electrical connection between lower connecter 352 and upper subassembly 346 of repeater 330, thereby providing a discontinuity in the electrical connection between the portion of drill string 30 below repeater 330 and the portion of drill string 30 above repeater 330.

Mandrel 338 includes axially extending generally tubular upper mandrel section 356 and axially extending generally tubular lower mandrel section 358. Upper mandrel section 356 is partially disposed and sealing configured within upper connecter 340. A dielectric member 360 electrically isolates upper mandrel section 356 and upper connecter 340. The outer surface of upper mandrel section 356 has a dielectric layer disposed thereon. Dielectric layer 362 may be, for example, a teflon layer. Together, dielectric layer 362 and dielectric member 360 service to electrically isolate upper connecter 340 from upper mandrel section 356.

Between upper mandrel section 356 and lower mandrel section 358 is a dielectric member 364 that, along with dielectric layer 362, serves to electrically isolate upper mandrel section 356 from lower mandrel section 358. Between lower mandrel section 358 and lower housing member 344 is a dielectric member 366. On the outer surface of lower mandrel section 358 is a dielectric layer 368 which, along with dielectric member 366, provides for electric isolation of lower mandrel section 358 with lower housing number 344. Dielectric layer 368 also provides for electric isolation between lower mandrel section 358 and isolation subassembly 348 as well as between lower mandrel section 358 and lower connecter 352. Lower end 370 of lower mandrel section 358 is disposed within lower connecter 352 and is in electrical communication with lower connecter 352.

Intermediate housing member 342 of outer housing 336 and upper mandrel section 356 of mandrel 338 define annular area 372. A receiver 374 and an electronics package 376 are disposed within annular area 372. In operation, receiver 374 receives an electromagnetic input signal carrying information which is transformed into an electrical signal that is passed onto electronics package 376 via electrical conductor 378. Electronics package 376 processes and amplifies the electrical signal. An output voltage is then applied between intermediate housing member 342 and lower mandrel section 358, which is electrically isolated from intermediate housing member 342 and electrically connected to lower connector 352, via terminal 380 on intermediate housing member 342 and terminal 382 on lower mandrel section 358. The voltage applied between intermediate housing member 342 and lower connector 352 generates the electromagnetic output signal that is radiated into the earth carrying information.

Figure 5:
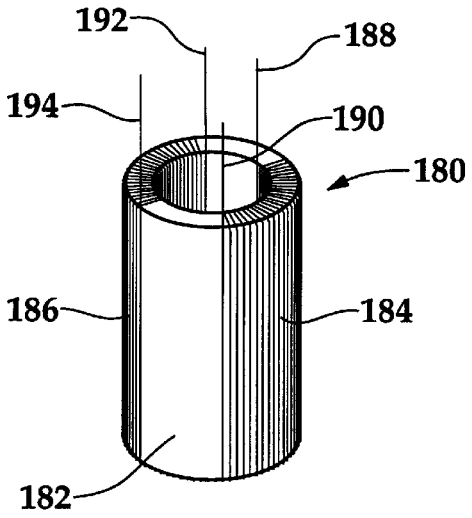
FIG. 5 is a schematic illustration of a toroid having primary and secondary windings wrapped therearound for a fail safe downhole signal repeater of the present invention.

Referring now to FIG. 5, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary of the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings.

Toroid 180 of the present invention may serve as the receivers and transmitters as described with reference to FIGS. 1, 2 and 4 such as receivers 48, 49, 56, 120, 374 and transmitters 44, 52, 53, 60 and 124. Toroid 180 of the present invention may also serve as the transceiver 174 as described with reference to FIG. 3. The following description of the orientation of windings 184 and windings 186 will therefore be applicable to all such receivers, transmitters and transceivers.

With reference to FIGS. 2 and 5, windings 184 have a first end 188 and a second end 190. First end 188 of windings 184 is electrically connected to electronics package 122. When toroid 180 serves as receiver 120, windings 184 serve as the secondary wherein first end 188 of windings 184 feeds electronics package 122 with an electrical signal via electrical conductor 126. The electrical signal is processed by electronics package 122 as will be further described with reference to FIG. 11 below. When toroid 180 serves as transmitter 124, windings 184 serve as the primary wherein first end 188 of windings 184, receives an electrical signal from electronics package 122 via electrical conductor 128. Second end 190 of windings 184 is electrically connected to upper subassembly 92 of outer housing 82 which serves as a ground.

Windings 186 of toroid 180 have a first end 192 and a second end 194. First end 192 of windings 186 is electrically connected to upper subassembly 92 of outer housing 82. Second end 194 of windings 186 is electrically connected to lower connecter 98 of outer housing 82. First end 192 of windings 186 is thereby separated from second end 192 of windings 186 by isolations subassembly 94 which prevents a short between first end 192 and second end 194 of windings 186.

When toroid 180 serves as receiver 120, electromagnetic wave fronts, such as electromagnetic wave fronts 46 induce a current in windings 186, which serve as the primary. The current induced in windings 186 induces a current in windings 184, the secondary, which feeds electronics package 122 as described above. When toroid 180 serves as transmitter 124, the current supplied from electronics package 122 feeds windings 184, the primary, such that a current is induced in windings 186, the secondary. The current in windings 186 induces an axial current on drill string 30, thereby producing electromagnetic waves.

Due to the ratio of primary windings to secondary windings, when toroid 180 serves as receiver 120, the signal carried by the current induced in the primary windings is increased in the secondary windings. Similarly, when toroid 180 serves as transmitter 124, the current in the primary windings is increased in the secondary windings.

Figure 6:
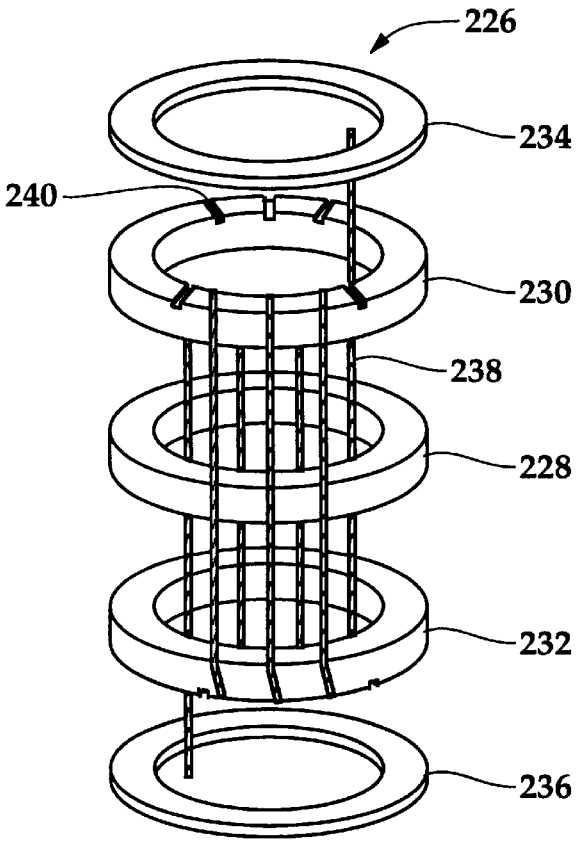
FIG. 6 is an exploded view of one embodiment of a toroid assembly for use as a receiver in a fail safe downhole signal repeater of the present invention.

Referring now to FIG. 6, an exploded view of a toroid assembly 226 is depicted. Toroid assembly 226 may be designed to serve, for example, as receiver 120 of FIG. 2. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 7:
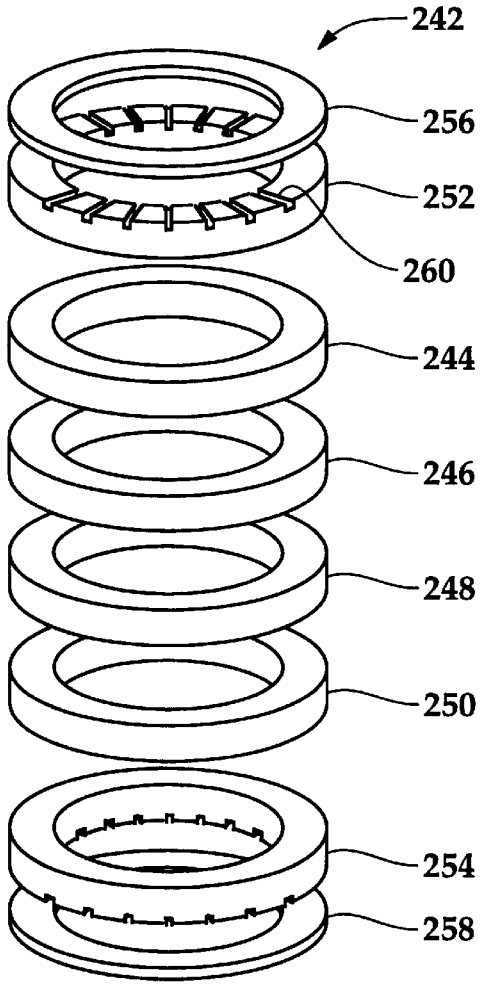
FIG. 7 is an exploded view of one embodiment of a toroid assembly for use as a transmitter in a fail safe downhole signal repeater of the present invention.

FIG. 7 depicts an exploded view of toroid assembly 242 which may serve, for example, as transmitter 124 of FIG. 2. Toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

As is apparent from FIGS. 6 and 7, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238.

Figure 8:
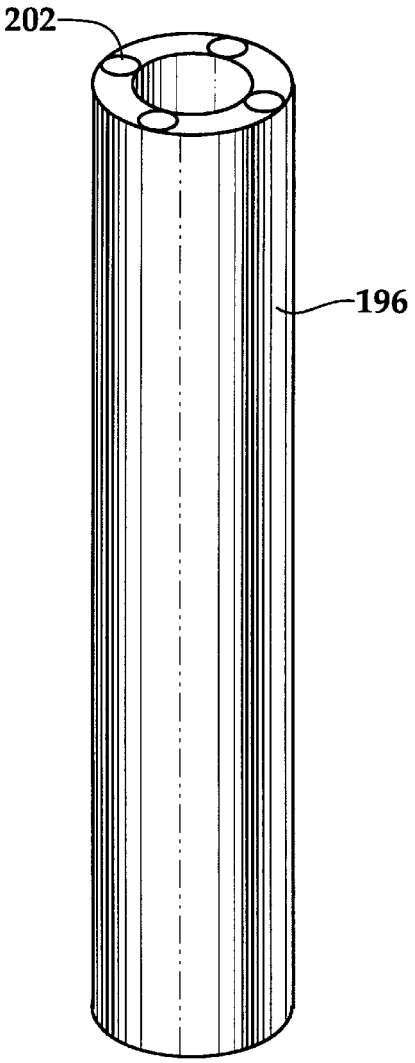
FIG. 8 is a perspective view of an annular carrier of an electronics package for a fail safe downhole signal repeater of the present invention.
Figure 9:
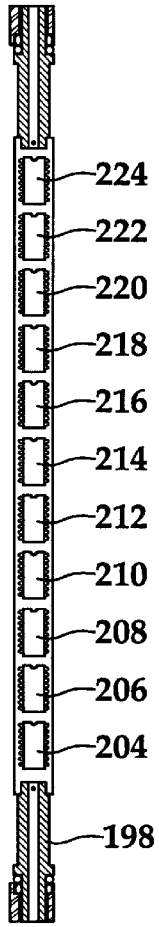
FIG. 9 is a perspective view of an electronics member having a plurality of electronic devices thereon for a fail safe downhole signal repeater of the present invention.
Figure 10:
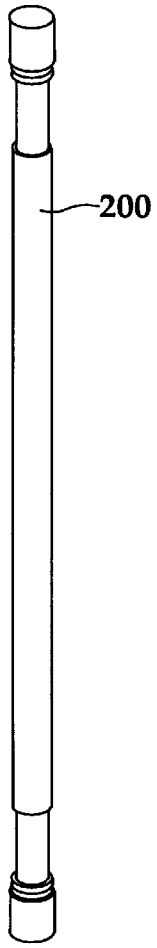
FIG. 10 is a perspective view of a battery pack for a fail safe downhole signal repeater of the present invention.

Turning next to FIGS. 8, 9 and 10 collectively and with reference to FIG. 2, therein is depicted the components of electronics package 122 of the present invention. Electronics package 122 includes an annular carrier 196, an electronics member 198 and one or more battery packs 200. Annular carrier 196 is disposed between outer housing 82 and mandrel 84. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 which will be required for a specific implementation of downhole signal repeater 76 of the present invention.

Electronics member 198 is insertable into an axial opening 202 of annular carrier 196. Electronics member 198 receives an electrical signal from first end 188 of windings 184 when toroid 180 serves as receiver 120. Electronics member 198 includes a plurality of electronic devices such as limiter 204, preamplifier 206, notch filter 208, bandpass filters 210, phase lock loop 212, timing devices 214, shift registers 216, comparators 218, parity check 220, storage devices 222, and amplifier 224. The operation of these electronic devices will be more full discussed with reference to FIG. 11.

Battery packs 200 are insertable into axial openings 202 of axial carrier 196. Battery packs 200, which includes batteries such as nickel cadmium batteries or lithium batteries, are configured to provide the proper operating voltage and current to the electronic devices of electronics member 198 and to toroid 180.

Even though FIGS. 8–10 have described electronics package 122 with reference to annular carrier 196, it should be understood by one skilled in the art that a variety of configurations may be used for the construction of electronics package 122. For example, electronics package 122 may be positioned concentrically within mandrel 84 using several stabilizers and having a narrow, elongated shape such that a minimum resistance will be created by electronics package 122 to the flow of fluids within drill string 30.

Figure 11:
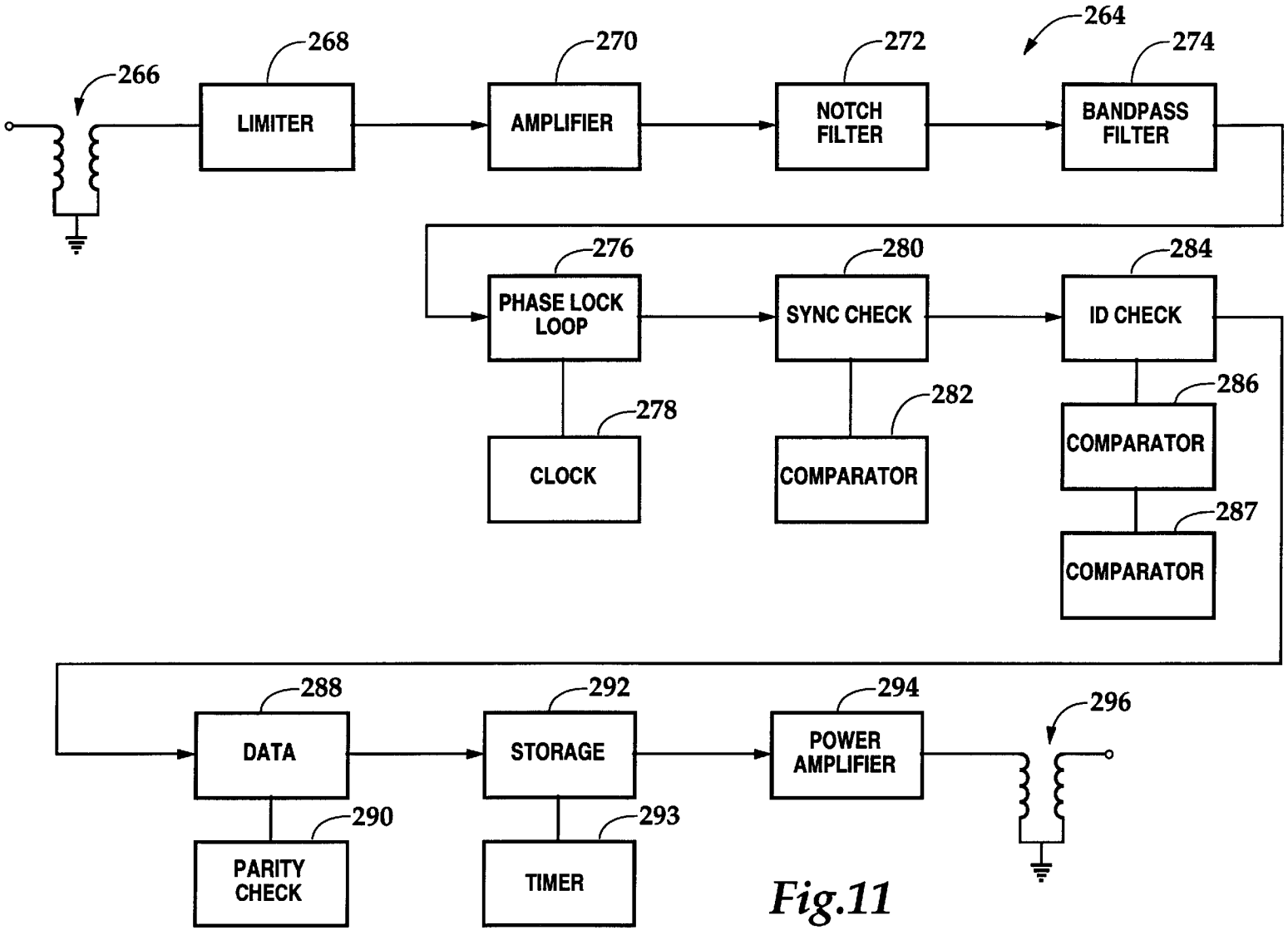
FIG. 11 is a block diagram of a signal processing method used by a fail safe downhole signal repeater of the present invention.

Turning now to FIG. 11 and with reference to FIG. 1, one embodiment of the method for processing the electrical signal within a fail safe downhole repeater, such as repeaters 34, 35, 36, is described. The method 264 utilizes a plurality of electronic devices such as those described with reference to FIG. 9. Method 264 provides for digital processing of the information carried in the electrical signal that is generated by receiver 266. Limiter 268 receives the electrical signal from receiver 266. Limiter 268 may include a pair of diodes for attenuating the noise in the electrical signal to a predetermined range, such as between about 0.3 and 0.8 volts. The electrical signal is then passed to amplifier 270 which may amplify the electrical signal to a predetermined voltage suitable of circuit logic, such as five volts. The electrical signal is then passed through a notch filter 272 to shunt noise at a predetermined frequency, such as 60 hertz which is a typical frequency for noise in an offshore application in the United States whereas a European application may have a 50 hertz notch filter. The electrical signal then enters a bandpass filter 274 to eliminate unwanted frequencies above and below the desired frequency to recreate a signal having the original frequency, for example, two hertz.

The electrical signal is then fed through a phase lock loop 276 that is controlled by a precision clock 278 to assure that the electrical signal which passes through bandpass filter 234 has the proper frequency and is not simply noise. As the electrical signal will include a certain amount of carrier frequency, phase lock loop 276 is able to verify that the received signal is, in fact, a signal carrying information to be retransmitted. The electrical signal then enters a series of shift registers that perform a variety of error checking features.

Sync check 280 reads, for example, the first six bits of the information carried in the electrical signal. These first six bits are compared with six bits that are stored in comparator 282 to determine whether the electrical signal is carrying the type of information intended for a repeater such as repeaters 34, 35, 36 of FIG. 1. For example, the first six bits in the preamble to the information carried in electromagnetic wave fronts 46 must carry the code stored in comparator 282 in order for the electrical signal to pass through sync check 280. Each of the repeaters of the present invention, such as repeaters 34, 35, 36, will require the same code in comparator 282.

If the first six bits in the preamble correspond with that in comparator 282, the electrical signal passes to a repeater identification check 284. Identification check 284 determines whether the information received by a specific repeater is intended for that repeater. The comparator 286 of repeater 34 will require a specific binary code while comparator 286 of repeater 35 will require a different binary code. For example, because electromagnetic wave fronts 46 are intended for repeater 34, the preamble information carried by electromagnetic wave fronts 46 will correspond with the binary code stored in comparator 286 of repeater 34. As explained above, however, repeater 35 is disposed within wellbore 38 within the range of electromagnetic wave fronts 46. Repeater 35 will, therefore, receive electromagnetic wave fronts 46 and determine that electromagnetic wave fronts 46 were not intended for repeater 35. Identification check 284, however, will recognize that electromagnetic wave fronts 46 were intended for repeater 34 by matching the binary code in comparator 287 and will process the signal as described below thus, providing a fail safe method for transmitting information between surface equipment and downhole equipment.

After passing through identification check 284, the electrical signal is shifted into a data register 288 which is in communication with a parity check 290 to analyze the information carried in the electrical signal for errors and to assure that noise has not infiltrated and abrogated the data stream by checking the parity of the data stream. If no errors are detected, the electrical signal is shifted into one or more storage registers 292. Storage registers 292 receive the entire sequence of information and either pass the electrical signal directly into power amplifier 294, if the signal was intended for that repeater, or will store the information for a specified period of time determined by timer 293, if the signal was not intended for that repeater. For example, since electromagnetic wave fronts 46 are intended for repeater 34, the electrical signal will be passed directly into power amplifier 294 of repeater 34 and to transmitter 296. Transmitter 296 transforms the electrical signal into an electromagnetic signal, such as electromagnetic wave fronts 54, which are radiated into the earth to be picked up by repeater 35 and repeater 36 of FIG. 1.

Alternatively, since electromagnetic wave fronts 46 are not intended for repeater 35, the information will be stored by storage registers 292 of repeater 35 for a specified period of time determined by timer 293. As explained above, if repeater 35 receives electromagnetic wave fronts 54 within the time specified by timer 293, the information received and stored by repeater 35 from electromagnetic wave fronts 46 is discarded by repeater 35. If electromagnetic wave fronts 54 are not received by repeater 35 within the time specified by timer 293, the information carried in electromagnetic wave fronts 46 that was received by repeater 35 is passed into power amplifier 294 of repeater 35 and to transmitter 296 that generates electromagnetic wave fronts 55 which propagate to repeater 36 and electromagnetic pickup device 64.

Even though FIG. 11 has described sync check 280, identification check 284, data register 288 and storage register 292 as shift registers, it should be apparent to those skilled in the art that alternate electronic devices may be used for error checking and storage including, but not limited to, random access memory, read only memory, erasable programmable read only memory and a microprocessor.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A system for communicating information between surface equipment and downhole equipment comprising:

first and second repeaters disposed within a wellbore, the first and second repeaters receiving a first signal carrying the information;

a memory device operably disposed within the second repeater for storing the information carried in the first signal; and a timer device operably disposed within the second repeater, the timer device triggering the second repeater to retransmit the information by generating a second signal, after a predetermined time period, unless the second repeater has detected a third signal carrying the information transmitted by the first repeater.

2. The system as recited in claim 1 wherein the first repeater further includes an electromagnetic receiver.

3. The system as recited in claim 1 wherein the second repeater further includes an electromagnetic receiver.

4. The system as recited in claim 1 wherein the first repeater further includes an electromagnetic transceiver.

5. The system as recited in claim 1 wherein the second repeater further includes an electromagnetic transceiver.

6. The system as recited in claim 1 wherein the first repeater further includes an electromagnetic transmitter.

7. The system as recited in claim 1 wherein the second repeater further includes an electromagnetic transmitter.

8. The system as recited in claim 1 wherein the first repeater transmits the third signal carrying the information within the predetermined time period and wherein the third signal carrying the information is detected by the second repeater.

9. The system as recited in claim 8 wherein the first repeater further includes an electronics package, the electronics package transforms the first signal into an electrical signal, converts the information carried in the electrical signal from an analog format to a digital format, processes the information and converts the information carried in the electrical signal from a digital format to an analog format.

10. The system as recited in claim 9 wherein the electronics package determines whether the first signal is intended for the first repeater.

11. The system as recited in claim 9 wherein the electronics package determines whether the first signal is carrying the information and determines whether the information carried in the first signal is accurate.

12. The system as recited in claim 9 wherein the electronics package attenuates noise in the electrical signal to a predetermined voltage, amplifies the electrical signal to a predetermined voltage, shunts noise in the electrical signal in first a predetermined frequency range and eliminates the unwanted frequencies above and below a second predetermined frequency.

13. The system as recited in claim 8 wherein the memory device discards the information carried in the first signal.

14. The system as recited in claim 1 wherein the second repeater further includes an electronics package, the electronics package transforms the first signal into an electrical signal, converts the information carried in the electrical signal from an analog format to a digital format, processes the information and converts the information carried in the electrical signal from a digital format to an analog format.

15. The system as recited in claim 14 wherein the electronics package determines whether the first signal is intended for the second repeater.

16. The system as recited in claim 14 wherein the electronics package determines whether the first signal is carrying the information and determines whether the information carried in the first signal is accurate.

17. The system as recited in claim 14 wherein the electronics package attenuates noise in the electrical signal to a predetermined voltage, amplifies the electrical signal to a predetermined voltage, shunts noise in the electrical signal in first a predetermined frequency range and eliminates the unwanted frequencies above and below a second predetermined frequency.

18. A system for communicating information between surface equipment and downhole equipment comprising first and second repeaters disposed within a wellbore, the first and second repeater each having an electromagnetic receiver, an electromagnetic transmitter and an electronics package, the first and second repeaters receiving a first electromagnetic signal carrying the information, the electronics package of the second repeater including a memory device for storing the information carried in the first electromagnetic signal and a timer device for triggering the second repeater to retransmit the information by generating a second electromagnetic signal, after a predetermined time period, unless the electromagnetic receiver of the second repeater has detected a third electromagnetic signal carrying the information transmitted by the electromagnetic transmitter of the first repeater.

19. The system as recited in claim 18 wherein the electromagnetic transmitter of the first repeater transmits the third electromagnetic signal carrying the information within the predetermined time period and wherein the third electromagnetic signal carrying the information is detected by the transmitter of the second repeater.

20. The system as recited in claim 19 wherein the electronics package of the first repeater transforms the first electromagnetic signal into an electrical signal, converts the information carried in the electrical signal from an analog format to a digital format, processes the information and converts the information carried in the electrical signal from a digital format to an analog format.

21. The system as recited in claim 20 wherein the electronics package of the first repeater determines whether the first electromagnetic signal is intended for the first repeater.

22. The system as recited in claim 20 wherein the electronics package of the first repeater determines whether the first electromagnetic signal is carrying the information and determines whether the information carried in the first electromagnetic signal is accurate.

23. The system as recited in claim 20 wherein the electronics package of the first repeater attenuates noise in the electrical signal to a predetermined voltage, amplifies the electrical signal to a predetermined voltage, shunts noise in the electrical signal in first a predetermined frequency range and eliminates the unwanted frequencies above and below a second predetermined frequency.

24. The system as recited in claim 19 wherein the memory device discards the information carried in the first electromagnetic signal.

25. The system as recited in claim 18 wherein the electronics package of the second repeater transforms the first electromagnetic signal into an electrical signal, converts the information carried in the electrical signal from an analog format to a digital format, processes the information and converts the information carried in the electrical signal from a digital format to an analog format.

26. The system as recited in claim 25 wherein the electronics package of the second repeater determines whether the first signal is intended for the second repeater.

27. The system as recited in claim 25 wherein the electronics package of the second repeater determines whether the first signal is carrying the information and determines whether the information carried in the first signal is accurate.

28. The system as recited in claim 25 wherein the electronics package of the second repeater attenuates noise in the electrical signal to a predetermined voltage, amplifies the electrical signal to a predetermined voltage, shunts noise in the electrical signal in first a predetermined frequency range and eliminates the unwanted frequencies above and below a second predetermined frequency.

29. A method for communicating information between surface equipment and downhole equipment, the method comprising the steps of:

detecting a first signal carrying the information by first and second repeaters disposed within a wellbore;

storing the information carried by the first signal in the second repeater; and transmitting a second signal carrying the information from the second repeater, after a predetermined time period, unless the second repeater has detected a third signal carrying the information transmitted by the first repeater.

30. The method as recited in claim 29 further including the steps of transmitting the third signal carrying the information from the first repeater within the predetermined time period and detecting the third signal carrying the information by the second repeater.

31. The method as recited in claim 30 wherein the first repeater further performs the steps of:

transforming the first signal into an electrical signal;

converting the information carried in the electrical signal from an analog format to a digital format;

processing the information; and converting the information carried in the electrical signal from a digital format to an analog format.

32. The method as recited in claim 31 wherein the step of processing the information further includes determining that the first signal is intended for the first repeater.

33. The method as recited in claim 31 wherein the step of processing the information further includes determining that the first signal is carrying the information and determining that the information carried in the first signal is accurate.

34. The method as recited in claim 31 wherein the step of processing the information further includes the steps of:

attenuating noise in the electrical signal to a predetermined voltage;

amplifying the electrical signal to a predetermined voltage;

shunting noise in the electrical signal in first a predetermined frequency range; and eliminating the unwanted frequencies above and below a second predetermined frequency.

35. The method as recited in claim 30 further including the step of discarding the information carried by the first signal from the second repeater.

36. The method as recited in claim 29 wherein the second repeater further performs the steps of:

transforming the first signal into an electrical signal;

converting the information carried in the electrical signal from an analog format to a digital format;

processing the information; and converting the information carried in the electrical signal from a digital format to an analog format.

37. The method as recited in claim 36 wherein the step of processing the information further includes determining that the first signal is intended for the second repeater.

38. The method as recited in claim 36 wherein the step of processing the information further includes determining that the first signal is carrying the information and determining that the information carried in the first signal is accurate.

39. The method as recited in claim 36 wherein the step of processing the information further includes the steps of:

attenuating noise in the electrical signal to a predetermined voltage;

amplifying the electrical signal to a predetermined voltage;

shunting noise in the electrical signal in first a predetermined frequency range; and eliminating the unwanted frequencies above and below a second predetermined frequency.

40. The method as recited in claim 29 wherein the first signal is an electromagnetic signal.

41. The method as recited in claim 29 wherein the second signal is an electromagnetic signal.

42. The method as recited in claim 29 wherein the third signal is an electromagnetic signal.

* * * * *